US009214743B2

(12) United States Patent
Duesterhoeft et al.

(10) Patent No.: US 9,214,743 B2
(45) Date of Patent: Dec. 15, 2015

(54) RIGHT ANGLE CONNECTOR ASSEMBLY

(71) Applicant: Tyco Electronics Corporation, Berwyn, PA (US)

(72) Inventors: Scott Stephen Duesterhoeft, Etters, PA (US); Douglas John Hardy, Middletown, PA (US); John Wesley Hall, Harrisburg, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 70 days.

(21) Appl. No.: 14/262,329

(22) Filed: Apr. 25, 2014

(65) Prior Publication Data

US 2015/0311602 A1 Oct. 29, 2015

(51) Int. Cl.
*H01R 4/48* (2006.01)

(52) U.S. Cl.
CPC ..... *H01R 4/4818* (2013.01)

(58) Field of Classification Search
CPC ..... H01R 4/4872; H01R 13/745
USPC ..... 439/817, 565, 550, 557, 824, 916
See application file for complete search history.

(56) References Cited

U.S. PATENT DOCUMENTS 4,111,513 A * 9/1978 Thurston ..... H01R 9/032 439/607.47
7,544,068 B2 * 6/2009 Glaab, III ..... H01R 13/512 439/607.01
7,896,687 B1 * 3/2011 Schweitzer ..... H01R 9/032 439/320
2011/0053421 A1 * 3/2011 Mostoller ..... H01R 13/562 439/625

OTHER PUBLICATIONS

Tyco Electronics, Section Catalog 1308073-1; Issued Dec. 2009; Main Catalog 1654400-1; Chapter 7—Issued Mar. 2010; pp. 7/2-7/5.

* cited by examiner

*Primary Examiner* — Phuongchi T Nguyen

(57) ABSTRACT

A connector assembly includes a dielectric having a right angle body including a first segment and a second segment and defining a right angle chamber extending through the first and second segments. At least one door at a right angle corner of the body provides access to the right angle chamber through a rear opening in an open state, and restricts access to the rear opening in a closed state. A female center contact in the right angle chamber in the first segment has a terminating end configured to electrically connect to a cable conductor of a cable received in the right angle chamber in the second segment. A front shield receives the dielectric and forces the door to move from the open state to the closed state upon loading the dielectric into the front shield. A rear shield couples to the front shield.

20 Claims, 6 Drawing Sheets

RIGHT ANGLE CONNECTOR ASSEMBLY

BACKGROUND OF THE INVENTION

The subject matter herein relates generally to right angle connector assemblies.

A typical radio frequency (RF) connector assembly has a metal outer shell, an inner dielectric insert, and a center contact to carry an electrical signal which is secured within the inner dielectric insert. RF connector assemblies may be either plug connectors or jack connectors of either standard or reverse polarity configurations. RF connector assemblies may be either terminated to a cable or to a printed circuit board (PCB). For cable-mounted applications, the RF connector assembly may be used with coaxial cables in order to maintain the shielding around the electrical connection that the coaxial design offers.

Typical RF connector assemblies are not without disadvantages. For instance, some RF connector assemblies are right angle connector assemblies where mating and terminating ends of the right angle connectors are oriented generally perpendicular to one another. Such right angle connector assemblies are complex and costly to design, manufacture, and assemble. It is difficult to maintain the impedance of such connectors between the mating and terminating ends as the signal path turns 90° within the connector housing. Additionally, typical right angle RF connectors do not enable automated manufacturing. For example, in some existing right angle RF connectors, the center contact is inserted into the connector housing and then bent 90° manually using a tool in order to convey the signal path through the right angle corner. Furthermore, often the dielectric insert does not fully surround the center contact along the 90° bend, so shielding may be reduced and the electrical signal may be degraded.

In addition, housing components of typical RF connectors are often manufactured through a die cast process, which creates strong parts but is not as adapted for mass volume automated assembly as, for example, stamping and forming sheet metal to produce multiple identical parts on a carrier strip. Typical RF connectors also include many individual pieces, which makes automated assembly difficult. For example, the dielectric housing that surrounds the center contact along linear portions (e.g., not even along the right angle bend) may include two pieces that are each received in a respective corresponding shield and pressed together when the two shields are assembled. Thus, due to the complexity, number of different pieces, and manufacturing processes, typical right angle RF connectors are assembled by hand, which is time consuming.

A need remains for a right angle connector assembly that provides effective signal path shielding, reduces components, and allows for automatable manufacturing and assembly.

BRIEF DESCRIPTION OF THE INVENTION

In an exemplary embodiment, a connector assembly includes a dielectric having a right angle body. The body includes a first segment and a second segment extending from the first segment at a right angle corner of the body. The body defines a right angle chamber extending through the first and second segments between a distal end of the first segment and a distal end of the second segment. The dielectric includes at least one door at the right angle corner. The door is rotatable between an open state and a closed state. The door provides access to the right angle chamber through a rear opening at the right angle corner in the open state. The door restricts access to the rear opening in the closed state. A female center contact is configured to be received in the right angle chamber in the first segment of the dielectric. The female center contact has a mating end configured to electrically connect to a mating contact of a mating connector and a terminating end configured to electrically connect to a cable conductor of a cable received in the right angle chamber in the second segment. A front shield receives a front of the dielectric. Upon loading the dielectric into the front shield, the front shield forces the door to move from the open state to the closed state. A rear shield receives a rear of the dielectric. The rear shield is configured to couple to the front shield.

Optionally, the front shield includes at least one closing tab configured to force the door to move from the open state to the closed state as the front of the dielectric is loaded into the front shield. The female center contact may be received into the right angle chamber through the rear opening at the right angle corner when the door is in the open state. The female center contact may be confined within the right angle chamber when the door is rotated to the closed state. The dielectric may include two doors and the front shield may include two closing tabs. The closing tabs may differ in length such that the closing tabs force the doors to close in a staggered sequence.

In an exemplary embodiment, a connector assembly includes a dielectric having a right angle body including a first segment and a second segment oriented at a right angle to the first segment. The body defines a right angle chamber extending through the first and second segments between a distal end of the first segment and a distal end of the second segment. A female center contact is configured to be received in the right angle chamber in the first segment of the dielectric. The female center contact has a mating end configured to electrically connect to a mating contact of a mating connector and a terminating end configured to electrically connect to a cable conductor of a cable received in the right angle chamber through an opening at the distal end of the second segment. The cable conductor is oriented perpendicular to the female center contact within the first segment. The terminating end includes a flared receptacle having first and second arms that engage opposite sides of the cable conductor to create a mechanical and electrical connection with the cable conductor.

DETAILED DESCRIPTION OF THE INVENTION

Figure 1:
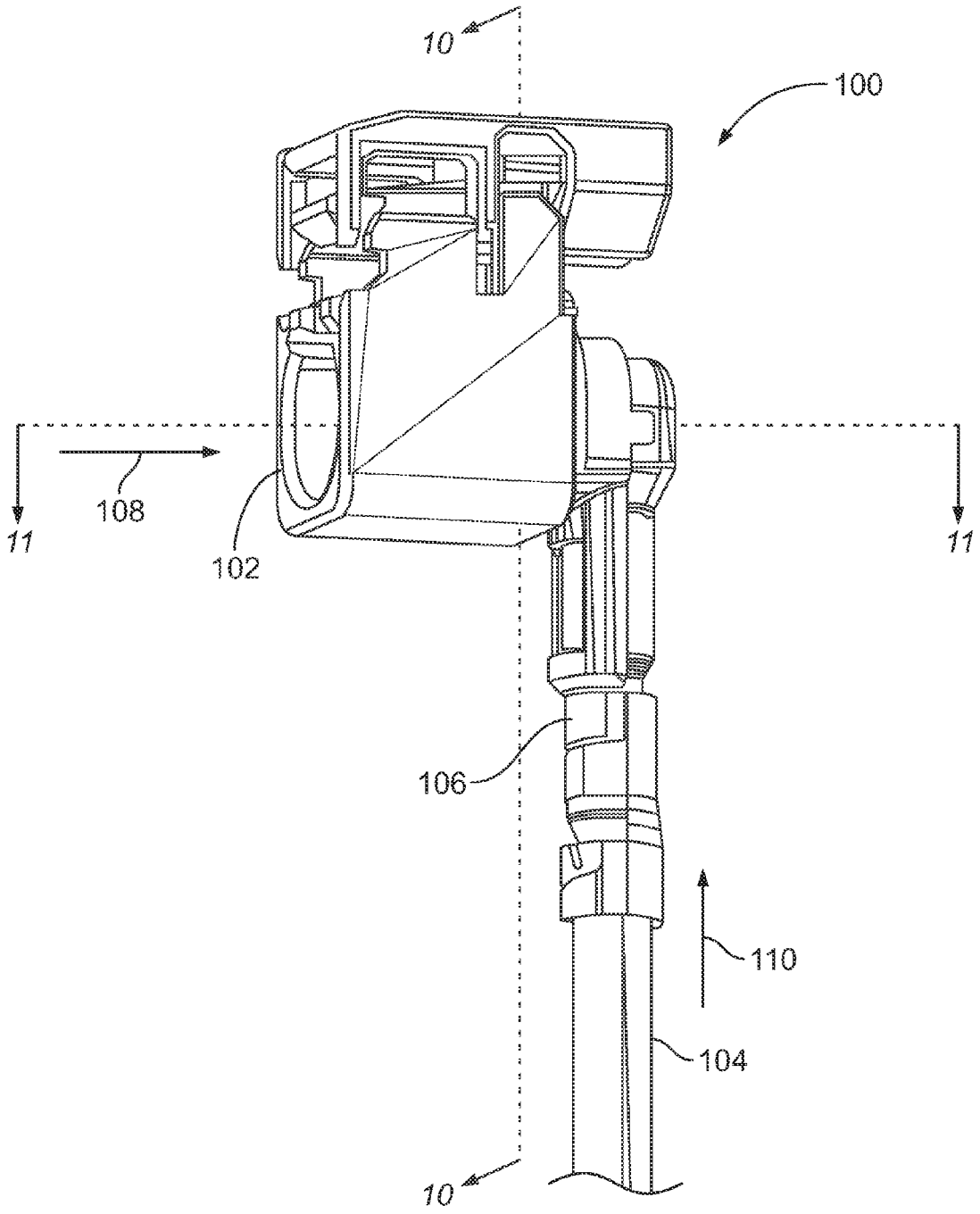
FIG. 1 is a perspective view of a connector assembly formed in accordance with an exemplary embodiment.

FIG. 1 is a perspective view of a connector assembly 100 formed in accordance with an exemplary embodiment. The connector assembly 100 is configured to mate with a mating connector (not shown) at a mating end 102 to provide an electrical signal path between the two connectors when mated. The connector assembly 100 may be a plug and the mating connector may be a jack. Optionally, the connector assembly 100 may be the jack and the mating connector may be the plug. The mating connector loads into the connector assembly 100 through the mating end 102 along a loading direction 108. The connector assembly 100 is terminated to a cable 104 at a terminating end 106. Optionally, the mating end 102 may form a separable connection with the mating connector, and the terminating end 106 may form a non-separable connection with the cable 104. The cable 104 may be a coaxial cable. Optionally, the connector assembly 100 may terminate to a PCB (not shown) instead of the cable 104, or the connector assembly 100 may be configured to terminate to either the cable 104 or a PCB. The cable 104 loads into the connector assembly 100 at the terminating end 106 along a loading direction 110.

The connector assembly 100 has a right angle shape. As used herein, "right angle" generally refers to two planes that are generally perpendicular and/or have a relative angle of approximately 90°, though the angle does not have to be exact. For example, a cross-sectional plane at the mating end 102 may be generally perpendicular to a cross-sectional plane at the terminating end 106. As such, the loading direction 108 of the mating connector (not shown) may be generally perpendicular to the loading direction 110 of the cable 104. The connector assembly 100 may also be referred to herein as "connector," "right angle connector," and/or "right angle RF connector." In alternative embodiments, the connector 100 may be designed with a shape other than right angle, such as having an angle between the cable 104 and the mating connector in the range of 45° to 135°.

The connector 100 may be used in the automotive industry. For example, the connector 100 may electrically couple to an antenna within a key fob. Optionally, the connector 100 may be applied in various other industries that utilize RF communications, as known in the art. The connector 100 may be designed to operate at radio frequencies in the megahertz (MHz) range, as also known in the art.

Figure 2:
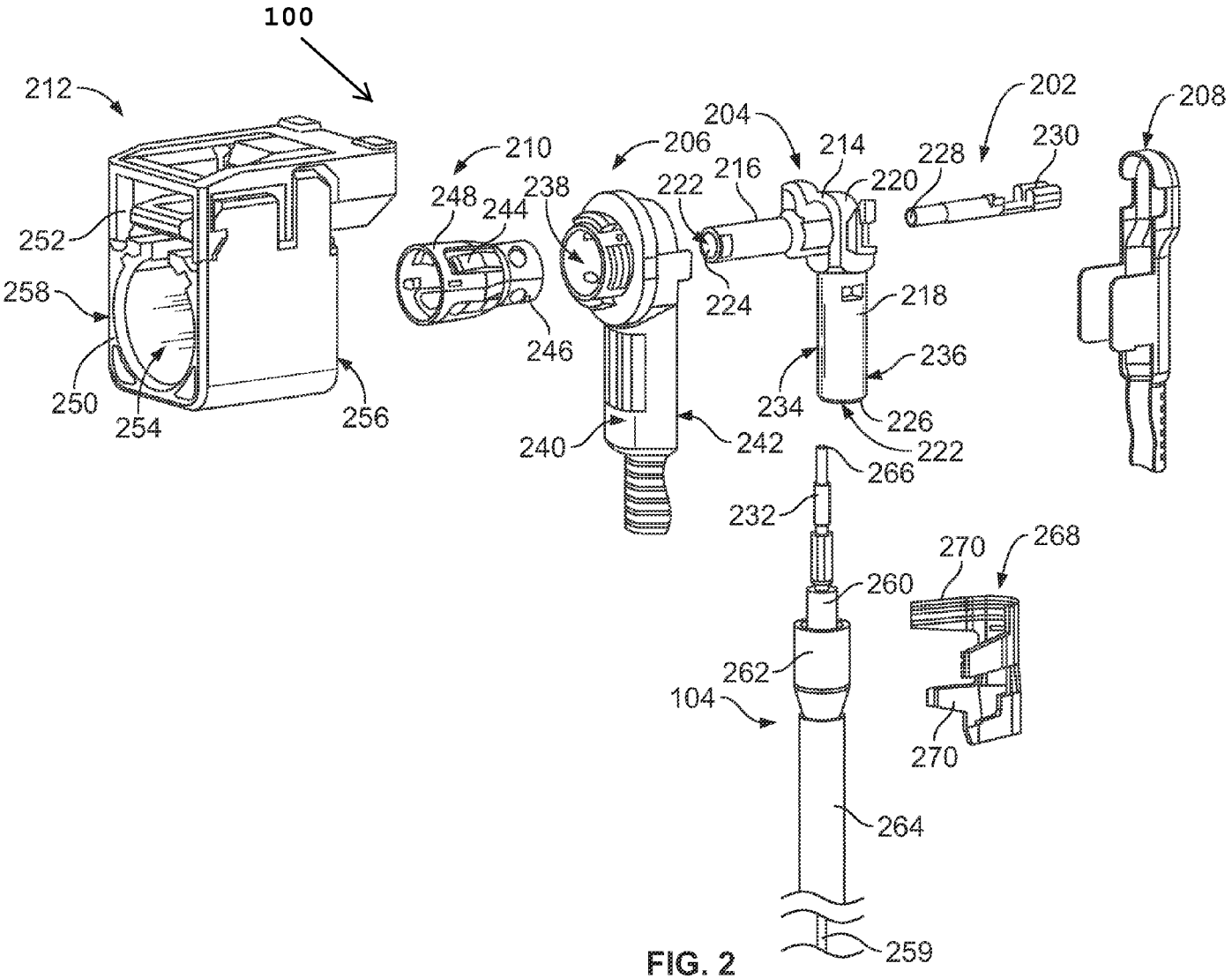
FIG. 2 is an exploded view of the connector assembly of FIG. 1.

FIG. 2 is an exploded view of the connector assembly 100 of FIG. 1. The connector 100 includes a female center contact 202, a dielectric 204, a front shield 206, a rear shield 208, an outer contact 210, and an outer housing 212. The dielectric 204 has a right angle body 214 including a first segment 216 and a second segment 218. The second segment 218 extends from the first segment 216 at a right angle corner 220 of the body 214. The body 214 defines a right angle chamber 222 extending through the first and second segments 216 and 218 between a distal end 224 of the first segment 216 and a distal end 226 of the second segment 218. The dielectric 204 is manufactured from a generally non-conductive material, such as a plastic material. The dielectric material may be a composite material.

The female center contact 202 is received in the right angle chamber 222 in the first segment 216 of the dielectric 204. The female center contact 202 has a mating end 228 configured to electrically connect to a mating contact (not shown) of the mating connector (not shown). The mating end 228 may define a socket that is designed to receive and mechanically connect to a male pin, blade, or the like, of the mating contact. In an alternative embodiment, the center contact 202 may have a different mating interface, such as a pin. The female center contact 202 also has a terminating end 230 that is configured to electrically connect to a cable conductor 232 of the cable 104, which is received in the right angle chamber 222 in the second segment 218. The female center contact 202 serves as a splice that provides a conductive link between the mating contact of the mating connector and the cable conductor 232 of the cable 104. The female center contact 202 may be a stamped (i.e. cut) and formed contact, such as from a panel of sheet metal. Stamped and formed contacts may be less expensive to manufacture than machined contacts.

The front shield 206 is configured to receive and provide shielding to a front 234 of the dielectric 204. The front shield 206 defines a cavity 238 that extends through the front shield 206 between a front 240 and a rear 242 of the shield 206. The cavity 238 is sized to receive the first segment 216 of the dielectric 204 therethrough when the front 234 of the dielectric 204 is received in the front shield 206. In an exemplary embodiment, the front shield 206 is manufactured using a die cast process. The front shield 206 may be die cast to provide strength to withstand the stresses of the mounted cable 104 being pulled in various directions. In an alternative embodiment, the front shield 206 may be stamped and formed. The rear shield 208 is designed to receive a rear 236 of the dielectric 204 and provide shielding along the rear 236. The rear shield 208 is configured to couple to the front shield 206 to at least partially surround the second segment 218 of the dielectric 204. In an exemplary embodiment, the rear shield 208 is made of sheet metal that is stamped and formed. For example, the rear shield 208 may be stamped and formed on a carrier strip for mass production and automated assembly. Alternatively, the rear shield 208 may be die cast.

The outer contact 210 is configured to be electrically connected to an outer mating contact (not shown) of the mating connector (not shown). The outer contact 210 may include multiple biased deflectable fingers 244 that retain electrical and mechanical contact with the outer mating contact when the mating connector is mated to the connector 100. The outer contact 210 is configured to be inserted at least partially within the cavity 238 of the front shield 206. For example, the outer contact 210 may include a mounting interface or end 246 that is received within the cavity 238 from the front 240 and couples to the front shield 206. The outer contact 210 also includes a mating end 248 that extends forwards of the front shield 206 and defines a socket for mating with the outer mating contact of the mating connector. The outer contact 210 has a hollow cylindrical shape configured to receive the first segment 216 of the dielectric 204 (and the female center contact 202 within) therein. The first segment 216 extends through the cavity 238 of the front shield 206 and is received within the outer contact 210. The outer contact 210 may be stamped and formed of a conductive material.

The outer housing 212 is configured to couple to the front 240 of the front shield 206 at least partially surrounding the outer contact 210. The outer housing 212 has a mating interface 250 at a front 258 that defines a socket for mating with the mating connector (not shown). The mating interface 250 forms the mating end 102 of the connector 100. The outer housing 212 defines a channel 254 that extends from the mating interface 250 to a rear 256 of the outer housing 212. The channel 254 is configured to receive the outer contact 210, first segment 216 of the dielectric 204, and female center contact 202 therein through the rear 256. The outer housing 212 may be manufactured from an electrically insulating material, such as a plastic and/or a composite. The outer housing 212 may include a lock 252 which hooks to the mating connector and supports retention of the mating connector within the mating interface 250 of the housing 212. The lock 252 may include one or more latches, tabs, and the like, to provide forces that oppose movement of the mating connector and/or connector 100 in a disconnecting direction.

The cable 104 includes a cable conductor 232 that is configured to be received in the right angle chamber 222 in the second segment 218 of the dielectric 204. A mating end 266 of the cable conductor 232 electrically connects to the terminating end 230 of the female center contact 202 within the right angle chamber 222. The cable 104 may be a coaxial cable. For example, the cable 104 may have an inner center conductor 259, a tubular insulating layer 260 surrounding the center conductor 259 along the length of the cable 104, a tubular conducting shield 262 surrounding the insulating layer 260, and an insulating outer sheath or jacket 264. The tubular insulating layer 260 and/or the insulating outer jacket 264 may be formed of a dielectric material. The tubular conducting shield 262 may be manufactured as woven or braided metal strands, such as copper. The center conductor 259 may be a conductive metal, such as copper as well. Optionally, the center conductor 259 may define the cable conductor 232 that is configured to be connected to the female center contact 202. For example, the distal end of the center conductor 259 may form the mating end 266 that connects to the female center contact 202 directly. Alternatively, as in the illustrated embodiment, the cable conductor 232 may include a separate terminal terminated to the end of the center conductor 259. For example, a pin or blade contact may be attached (e.g., crimped, soldered, etc.) to the center conductor 259 of the cable 104, where the pin or blade forms the mating end 266 of the cable conductor 232 that connects to the female center contact 202.

A ferrule 268 may be used to crimp the connector 100 to the cable 104. The ferrule 268 may be stamped and formed on a carrier strip. The ferrule 268 is an open-barrel shape with at least one crimping arm 270. Alternatively, the ferrule 268 may be formed as a closed-barrel. The ferrule 268 is used to mechanically and electrically connect the connector 100 to the cable 104. For example, the ferrule 268 may be positioned to clinch the coupled front and rear shields 206, 208 to the tubular conducting shield 262 of the cable 104 for both electrical and mechanical coupling.

FIGS. 3-8 variously show assembly of the connector 100 in accordance with an exemplary embodiment.

Figure 3:
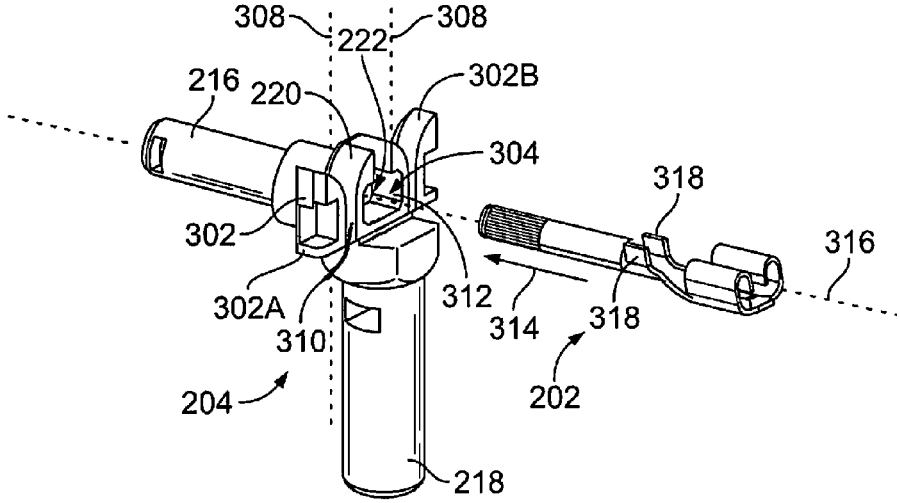
FIG. 3 is a perspective view of a female center contact poised for loading into a dielectric.

FIG. 3 is a perspective view of the female center contact 202 poised for loading into the dielectric 204. The dielectric 204 includes at least one door 302 at or near the right angle corner 220 of the body 214. The door 302 is rotatable between an open state and a close state. The door 302 provides access to the right angle chamber 222 through a rear opening 304 at the right angle corner 220 in the open state. In the closed state, the door 302 restricts access to the rear opening 304. The door 302 provides electrical insulation rearward of the female center contact 202. The door 302 holds the female center contact 202 in the right angle chamber 222 when the door 302 is in the closed state. The door 302 may be rotatable on a living hinge 306 (shown in FIG. 11) along an axis 308 that is parallel to the orientation of the second segment 218 of the dielectric 204. The dielectric 204, as shown, includes two doors 302A, 302B located on opposite first and second sides 310, 312 of the rear opening 304, respectively. The doors 302A, 302B are connected to the body 214 of the dielectric 204 via respective living hinges 306. The two doors 302A, 302B may be equally sized and mirror each other. Alternatively, the two doors 302A, 302B may have different sizes and/or shapes relative to each other. In an alternative embodiment, the dielectric 204 has a single door 302 that is sized to provide and restrict access to the rear opening 304.

During assembly, the at least one door 302 is positioned in the open state, and the female center contact 202 is loaded along loading direction 314 into the right angle chamber 222 through the rear opening 304. While loading, the female center contact 202 is oriented along an axis 316 that is parallel to the orientation of the first segment 216 of the dielectric 204. The female center contact 202 is received in the right angle chamber 222 in the first segment 216 of the dielectric 204. Optionally, the female center contact 202 includes at least one guide tab 318 that extends outward from the contact 202. The one or more guide tabs 318 may be used to guide the female center contact 202 during loading into the right angle chamber 222, so the female center contact 202 has the intended rotational orientation (e.g., rotation along the axis 316) for proper termination to the cable conductor 232 (shown in FIG. 2) and/or mating to the mating contact (not shown). The guide tabs 318 may also be used to reduce the tolerance between the diameter of the right angle chamber 222 and the diameter of the female contact 202 to reduce undesired movement of the female contact 202 relative to the dielectric 204 when the female contact 202 is within the dielectric 204. When the female center contact 202 is loaded within the dielectric 204, the combination forms a dielectric-contact sub-assembly 402 (shown in FIG. 4).

Figure 4:
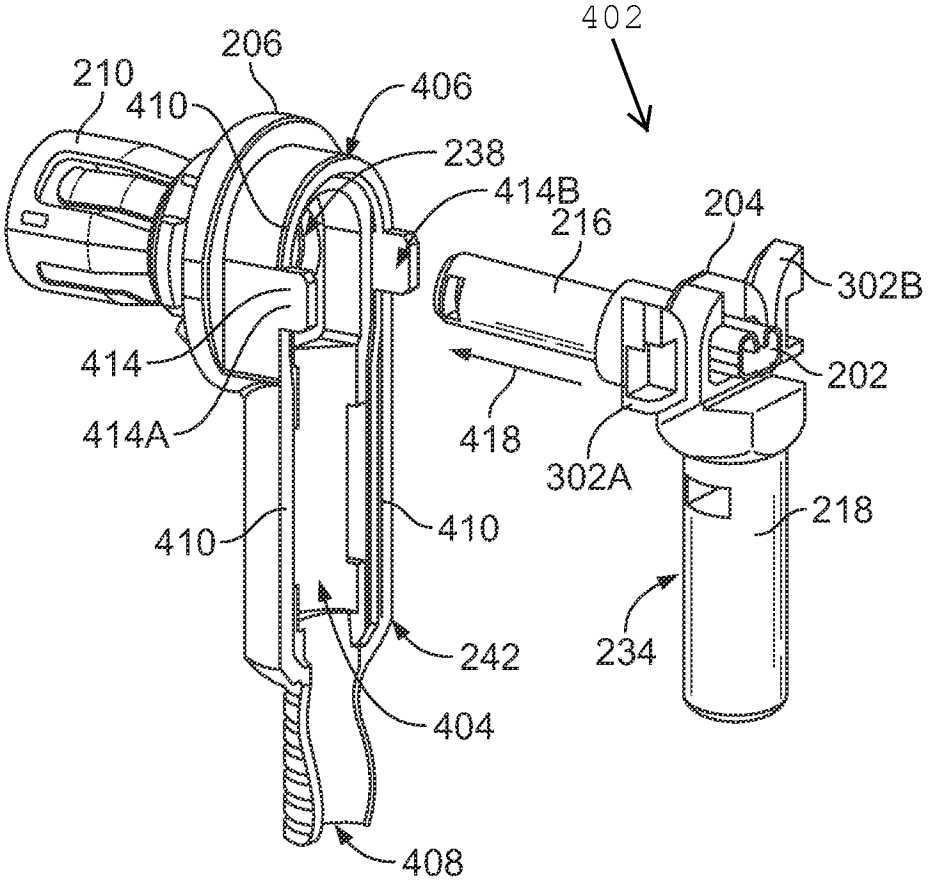
FIG. 4 is a perspective view of a dielectric-contact subassembly poised for mounting to a front shield.

FIG. 4 is a perspective view of the dielectric-contact sub-assembly 402 poised for mounting to the front shield 206. Optionally, the front shield 206 may be pre-assembled to the outer contact 210 prior to mounting the dielectric-contact sub-assembly 402. The front shield 206 defines a groove 404 along the rear 242. The groove 404 may extend from a top 406 to a bottom 408 of the front shield 206. In an exemplary embodiment, the groove 404 is bordered to the top and sides by a lip 410. The groove 404 is configured to receive at least the second segment 218 of the dielectric 204 therein. The groove 404 is not bordered by the lip 410 at the bottom 408 of the shield 206 to allow the conductive and shielding elements to extend linearly downward from the dielectric 204 to the cable 104 (shown in FIG. 2). In an exemplary embodiment, the front shield 206 includes at least one closing tab 414 that extends rearward from the lip 410. As shown in FIG. 4, the front shield 206 includes two closing tabs 414A, 414B located on opposite sides of the groove 404. The lengths of the closing tabs 414A, 414B may be staggered. For example, tab 414A may be longer (e.g., extend further from the lip 410) than tab 414B, or vice-versa.

During assembly, the dielectric-contact sub-assembly 402 is mounted to the front shield 206 along a loading direction 418. The front 234 of the dielectric 204 is loaded first such that the first segment 216 of the dielectric 204 extends through the cavity 238 of the shield 206. When the female center contact 202 and first segment 216 of the dielectric 204 are loaded into the outer contact 210, the center contact 202 is electrically isolated from the outer contact 210 by the material of the dielectric 204. Furthermore, upon loading, the second segment 218 is received in the groove 404. As the front 234 of the dielectric 204 is loaded into the front shield 206, each closing tab 414 forces a respective door 302 to move from the open state to the closed state. As shown, closing tab 414A forces door 302A, and tab 414B forces door 302B. The doors 302 and closing tabs 414 are positioned so the doors 302 close automatically when the dielectric 204 is assembled to the front shield 206.

Figure 5:
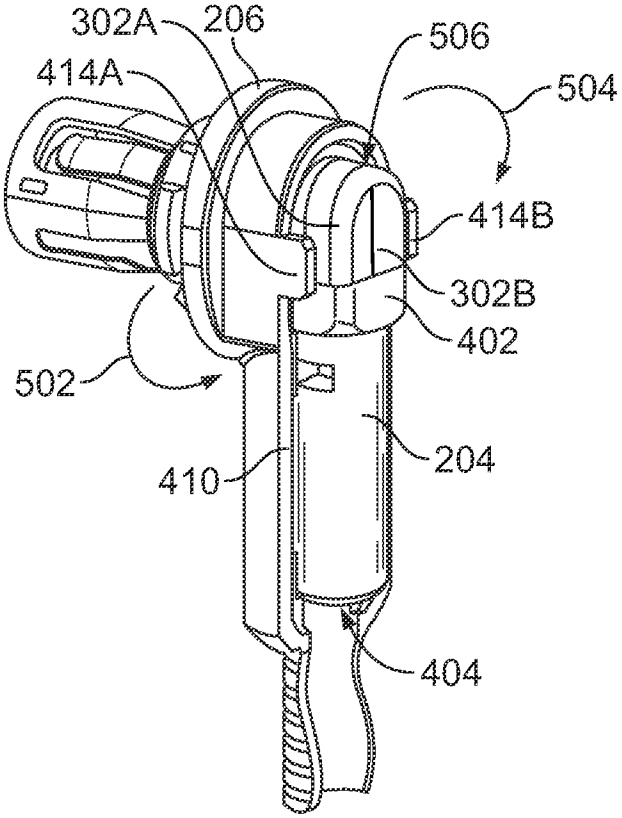
FIG. 5 is a perspective view of the dielectric-contact subassembly of FIG. 4 loaded into the front shield of FIG. 4.

FIG. 5 is a perspective view of the dielectric-contact sub-assembly 402 loaded into the front shield 206. As shown in FIG. 5, the doors 302 are in the closed state. Upon loading into the front shield 206, the doors 302 rotate towards the rear opening 304 (shown in FIG. 3) to restrict access to the rear opening 304. For example, the door 302A rotates along the direction 502, and the door 302B rotates along the direction 504. The doors 302A, 302B rotate until meeting each other at an interface 506 in the closed state. Since the female center contact 202 is within the right angle chamber 222 (shown in FIG. 3), when the doors 302 achieve the closed state the female center contact 202 is self-contained within the dielectric 204 by the doors 302. Thus, when the doors 302 are in the closed state, the female center contact 202 cannot be removed from the right angle chamber 222 through the rear opening 304, because the doors 302 block rearward movement of the contact 202.

In the embodiment in which the lengths of the closing tabs 414 are staggered, the staggered closing tabs 414 close the doors 302 in sequence to provide an overlapping cavity closure at the interface 506. For example, if closing tab 414A has a longer rearward length than closing tab 414B, the tab 414A would make contact with respective door 302A prior to closing tab 414B contacting door 302B when the dielectric 204 is being loaded into the front shield 206. As a result, door 302A rotates along direction 502 prior to door 302B rotating along direction 502, so door 302A reaches the closed state prior to door 302B reaching the closed state. The overlapping cavity closure may provide improved shielding at the interface 506, since the doors 302A, 302B at least partially overlap. Optionally, the closing tabs 414 may be the same length, such that the doors 302A, 302B close generally at the same time. In an alternative embodiment, the front shield 206 does not include separate closing tabs 414 that extend from the lip 410. Rather, the lip 410 serves the function of the closing tabs 414 to automatically force the doors 302 to the closed state upon loading the dielectric 204 into the groove 404 of the front shield 206.

The rotatable doors 302 provide an automatic mechanism for locking the female center contact 202 within the dielectric 204 during assembly, which improves the ease and efficiency of the assembly process. In addition, the doors 302 may be pre-assembled to the dielectric 204 prior to assembly of the connector 100, which reduces the number of individual components to assemble. For example, the dielectric 204 having attached doors 302 eliminates the need for a two-piece dielectric (e.g., dielectric and dielectric cover) during assembly as is typically used in the art. In addition, the one-piece dielectric 204 provides 360° shielding of the female center contact 202 at the right angle corner 220 (shown in FIG. 3), when the doors 302 are in the closed state.

Figure 6:
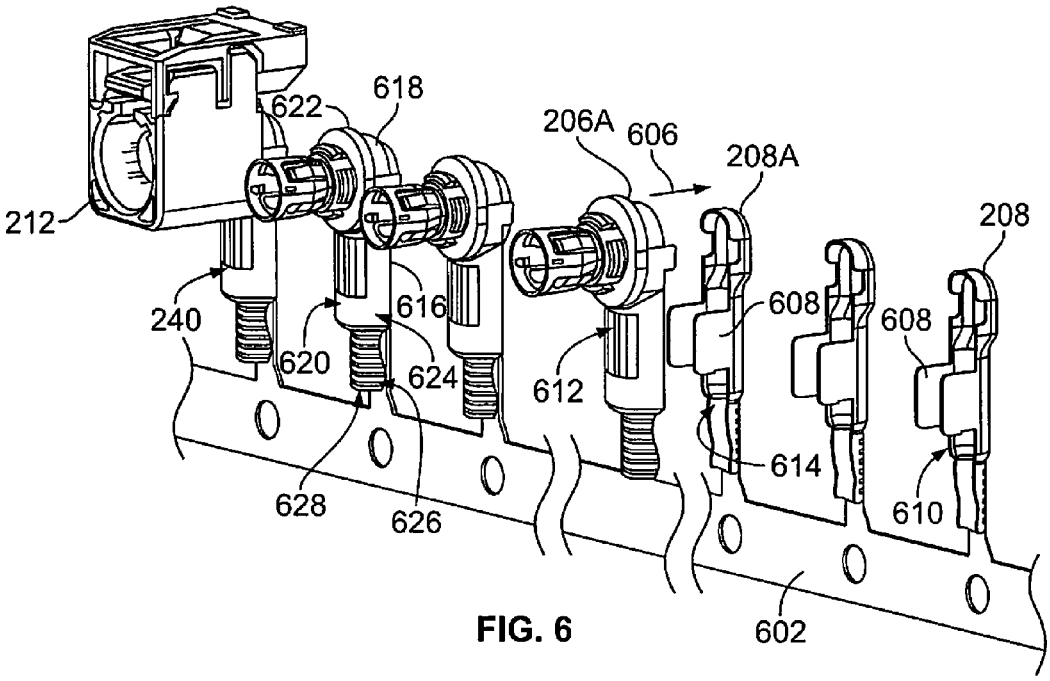
FIG. 6 illustrates multiple front shields coupled to respective rear shields attached to a carrier strip, one front shield poised for coupling to a rear shield on the carrier strip, and multiple rear shields on the carrier strip not coupled to front shields.

FIG. 6 illustrates multiple front shields 206 coupled to respective rear shields 208 attached to a carrier strip 602, one front shield 206A poised for coupling to a rear shield 208A on the carrier strip 602, and multiple rear shields 208 on the carrier strip 602 not coupled to any front shields. Once the dielectric-contact sub-assembly 402 (shown in FIG. 5) is loaded fully into the front shield 206, as shown in FIG. 5, the front shield 206 (e.g., containing the sub-assembly 402) is coupled to the rear shield 208. In an exemplary embodiment, the rear shield 208 is stamped and formed on the carrier strip 602. Optionally, the front shield 206 may be coupled to the rear shield 208 while the rear shield 208 is still mounted on the carrier strip 602 with multiple duplicate rear shields 208. Alternatively, the rear shield 208 may be removed from the carrier strip 602 prior to coupling with the front shield 206.

During assembly, the front shield 206A is moved in a loading direction 606 towards the rear shield 208A. The rear shield 208 may define a groove 614 that is configured to receive the rear 236 (shown in FIG. 2) of the dielectric 204 (shown in FIG. 2) therein. In an exemplary embodiment, the rear shield 208 includes at least one wing 608 that extends forward from a front 610 of the rear shield 208. The at least one wing 608 is used to couple the rear shield 208 to the front shield 206. For example, the front shield 206 may include at least one slot 612 that is sized to receive the wing 608. In an exemplary embodiment, during loading in the loading direction 606, the at least one wing 608 is inserted (e.g., received) through the corresponding slot 612 and fastened to couple the rear shield 208 to the front shield 206. For example, the at least one wing 608 may be fastened by crimping, melting, folding, soldering, gluing, or the like, the wing 608 to the area of the front shield 206 surrounding the slot 612. In an exemplary embodiment, the rear shield 208 includes two wings 608 located on opposing sides of the rear shield 208. In addition, the front shield 206 may include two slots 612 configured to receive each of the corresponding wings 608. Optionally, the two wings 608 may be fastened to each other to couple the rear shield 208 to the front shield 206.

When coupled, the rear shield 208 and the front shield 206 form a shield assembly 618. The rear shield 208 and the front shield 206 meet at an interface 616 that continuously stretches along a first side 620, a top 622, and a second side 624 of the shield assembly 618. However, the interface 616 does not extend along a bottom 626 of the shield assembly 618, which provides an opening 628 for the cable conductor 232 (shown in FIG. 2) to enter the shield assembly 618 to electrically connect to the female center contact 202 (shown in FIG. 2) contained therein. In an exemplary embodiment, the front shield 206 is produced by a die cast process, and the rear shield 208 is stamped and formed. As such, the shield assembly 618 may include a die cast piece interfacing with a stamped and formed piece.

After forming the shield assembly 618, the outer housing 212 may be mounted to the front 240 of the front shield 206. The outer housing 212 may be mounted either before or after the shield assembly 618 is removed from the carrier strip 602. The outer housing 212 may be coupled to the front shield 206 by various strategies known in the art, including threads, bayonets, latches, hooks, adhesives, deflectable extensions, rotation of the parts, or the like.

Figure 7:
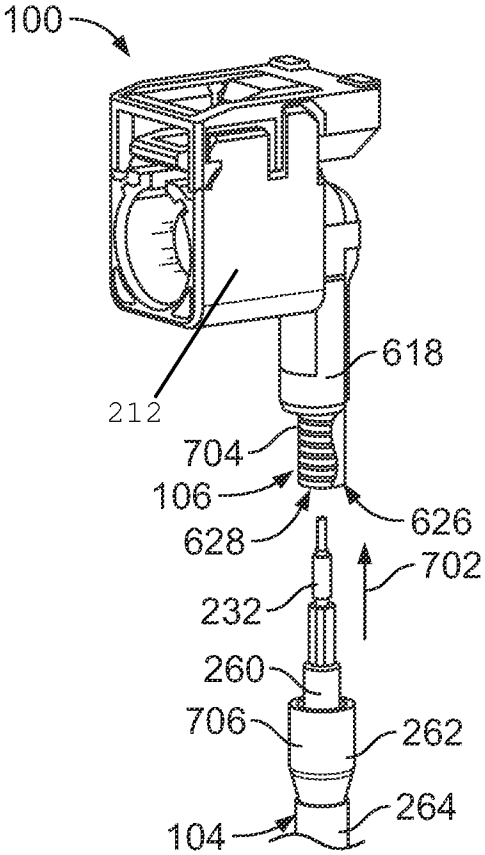
FIG. 7 is a perspective view of a cable poised for loading into a connector assembly.

FIG. 7 is a perspective view of the cable 104 poised for loading into the connector assembly 100. In an exemplary embodiment, the assembly of the connector assembly 100 is complete when the outer housing 212 is mounted and rear shield 208 is removed from the carrier strip 602. The connector assembly 100 is configured to be terminated (e.g., crimped) to a cable at the terminating end 106 to form a non-separable connection. Optionally, the assembly process of the connector assembly 100 may further include coupling the connector assembly 100 to the cable, such as cable 104.

The cable 104 is moved in the loading direction 702 towards the terminating end 106 of the connector 100. At least part of the cable 104 is inserted through the opening 628 at the bottom 626 of the shield assembly 618. For example, the cable conductor 232 and the insulating layer 260 may be inserted through the opening 628, while the conducting shield 262 and the outer jacket 264 do not enter through the opening 628.

The shield assembly 618 includes a mounting portion 704 located proximate to the bottom 626 thereof. The mounting portion 704 may have a smaller outer diameter than other portions of the shield assembly 618. The mounting portion 704 is configured to be coupled to the cable 104. In an exemplary embodiment, the cable 104 couples to the shield assembly 618 of the connector 100 by dressing a braid 706 of the cable 104 around the mounting portion 704. The braid 706 may be a distal portion of the conducting shield 262. For example, the cable 104 is loaded in the loading direction 702 and the mounting portion 704 of the shield assembly 618 is received between the insulating layer 260 and the conducting shield 262 of the cable 104, at least along part of the length of the dressed braid 706.

Figure 8:
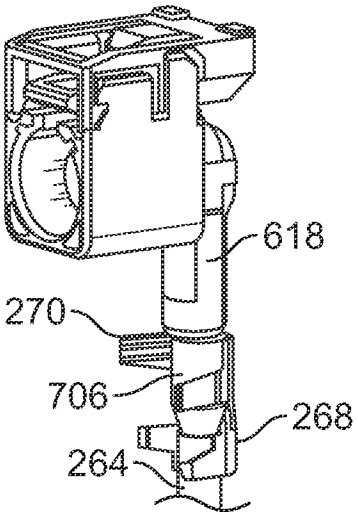
FIG. 8 is a perspective view of the cable of FIG. 7 loaded into the connector assembly of FIG. 7 and a ferrule poised for crimping the cable to the connector assembly.

FIG. 8 is a perspective view of the cable 104 loaded into the connector assembly 100 and the ferrule 268 poised for crimping the cable 104 to the connector assembly 100. In an exemplary embodiment, the connector 100 is fastened to the cable 104 by a crimping process using the ferrule 268. Once the braid 706 of the cable 104 is positioned around the mounting portion 704 (shown in FIG. 7) of the shield assembly 618, the ferrule 268 is placed on the braid 706. Crimping the ferrule 268 on the braid 706 mechanically fastens the braid 706 to the mounting portion 704. The ferrule 268 may include multiple crimping arms 270 that wrap around the braid 706 during the crimping process. Optionally, the ferrule 268 may also be crimped to the outer jacket 264 of the cable 104, which serves to prevent the insulating outer jacket 264 from sliding relative to the conducting shield 262. Furthermore, crimping the ferrule 268 to the braid 706 around the mounting portion 704 also serves to reinforce the coupling of the front and rear shields 206, 208. Since the mounting portion 704 is formed of a combination of both shields 206, 208 contacting each other at the interface 616 (shown in FIG. 6), crimping provides additional forces at the mounting portion 704 that press the shields 206, 208 together.

Figure 9:
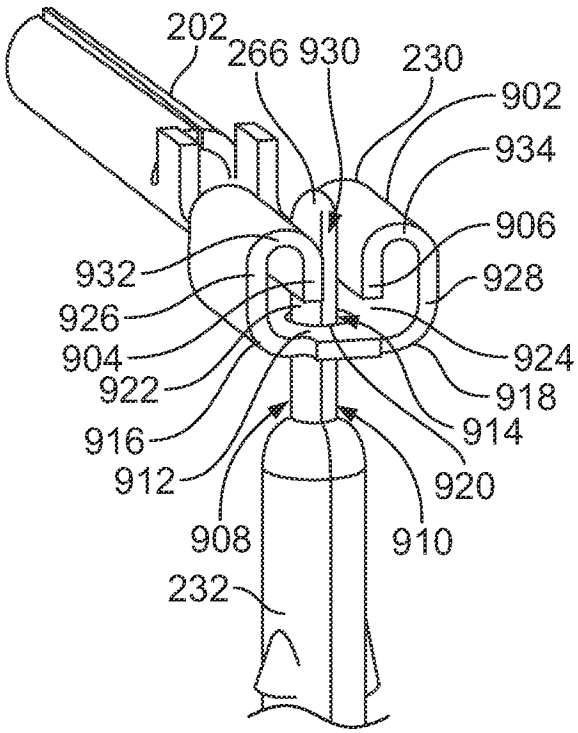
FIG. 9 is a perspective view of a cable conductor in mating contact with a female center contact in accordance with an exemplary embodiment.

FIG. 9 is a perspective view of the cable conductor 232 in mating contact with the female center contact 202 in accordance with an exemplary embodiment. Although the mating between the cable conductor 232 and the female contact 202 occurs within the right angle chamber 222 (shown in FIG. 2) in the dielectric 204 (shown in FIG. 2), the dielectric 204 and other components of the connector 100 (shown in FIG. 1) are hidden in FIG. 9 to show the mating connection in detail. In an exemplary embodiment, the terminating end 230 of the female center contact 202 includes a flared receptacle 902 having a first arm 904 and a second arm 906. The first and second arms 904, 906 are configured to engage opposite first and second sides 908 and 910, respectively, of the cable conductor 232 to create a mechanical and electrical connection with the cable conductor 232. Alternatively, the terminating end 230 may have a receptacle other than the flared receptacle 902 for mechanically and electrically connecting to the cable conductor 232.

The flared receptacle 902 includes a planar surface 912 having an aperture 914 at a center 920 thereof. The first and second arms 904, 906 curl from corresponding first and second edges 916, 918, of the planar surface 912 towards the center 920. As such, the planar surface 912 and the arms 904, 906 may be integrally connected. Optionally, the planar surface 912 may be a lower surface 912. The flared receptacle 902 may have first and second side walls 926, 928 that extend upwards from the lower surface 912. The first and second arms 904, 906 may extend generally downward from respective tops 932, 934 of the first and second side walls 926, 928 toward the lower surface 912 on opposing sides of the aperture 914 to define a contact region 930 therebetween. The mating end 266 of the cable conductor 232 extends through the aperture 914 and engages the first and second arms 904, 906 in the contact region 930. Additionally, the first and second arms 904, 906 may have flared tips 922, 924, respectively, at distal ends that are flared outward relative to the aperture 914. The flared tips 922, 924 define a guide section within the contact region 930 configured to guide the cable conductor 232 into an interference fit between the first and second arms 904, 906.

Figure 10:
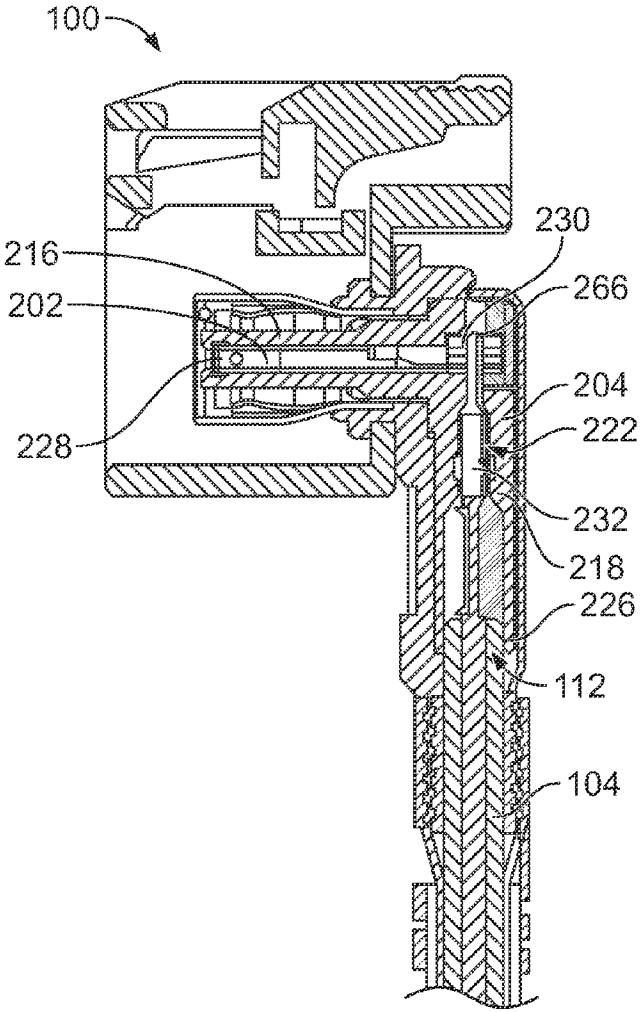
FIG. 10 is a side cross-section of the connector assembly of FIG. 1.

FIG. 10 is a side cross-section of the connector assembly 100 along line 10-10 of FIG. 1. FIG. 10 shows that the cable conductor 232 of the cable 104 is received in the right angle chamber 222 through an opening 112 at the distal end 226 of the second segment 218. Inside the right angle chamber 222, the mating end 266 of the cable conductor 232 mechanically and electrically contacts the female center contact 202 at the terminating end 230. The female center contact 202 is configured to allow both inline mating to the mating contact (not shown) of the mating connector (not shown) at the mating end 228 and perpendicular mating to the cable conductor 232 of the cable 104. The mating between the female contact 202 and the cable conductor 232 is described as perpendicular because the longitudinal axis of the cable conductor 232 within the second segment 218 of the dielectric 204 is oriented at an angle roughly 90° from the longitudinal axis of the female contact 202 within the first segment 216. Optionally, the cable conductor 232 may be mated to the female conductor 202 at an angle other than 90°. The female center contact 202 thus acts as a splice between the two different mating orientations of the mating connector and the cable 104, allowing the electrical signal path between the mating connector and the cable 104 to continue unobstructed.

Figure 11:
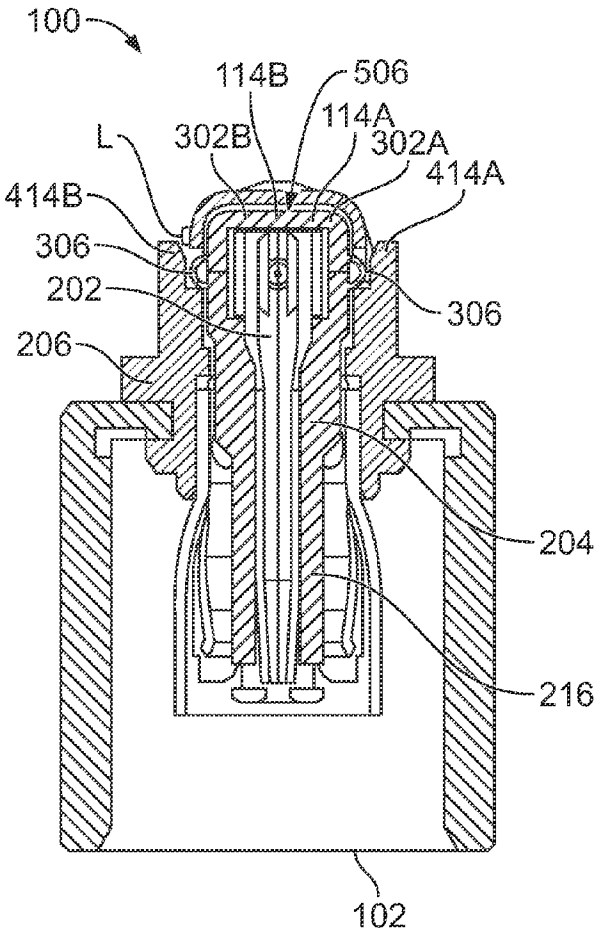
FIG. 11 is a top-down cross-section of the connector assembly of FIG. 1.

FIG. 11 is a top-down cross-section of the connector assembly 100 along line 11-11 of FIG. 1. In FIG. 11, the connector 100 is assembled, so the female center contact 202 is within the first segment 216 of the dielectric 204, and the dielectric 204 is loaded within the front shield 206, so the doors 302 are positioned in the closed state. As shown, the closing tabs 414 of the front shield 206 are staggered in length such that closing tab 414A extends further rearward (e.g., in the direction away from the mating end 102 of the connector assembly 100) than the closing tab 414B by a length of L. Since closing tab 414A is longer, tab 414A makes contact with door 302A sooner than tab 414B contacts door 302B when the dielectric 204 is being loaded into the front shield 206. As a result, closing tab 414A forces door 302A to rotate along the living hinge 306 to the closed state slightly before door 302B rotates along the corresponding living hinge 306 to the closed state, so the doors 302A, 302B close in sequence.

In an exemplary embodiment, the doors 302A, 302B may each be designed with a beveled edge 114A, 114B, respectively, to allow the doors 302A, 302B to overlap at the interface 506. For example, the door 302A that closes first may be beveled at the outer edge 114A, and the other door 302B may be beveled at the inner edge 114B. When the doors 302A, 302B are being closed, the door 302A closes first. The beveled edge 114B of the second door 302B interfaces with the beveled edge 114A of the first door 302A, allowing the second door 302B to partially overlap the first door 302A at the interface 506. The staggered closing tabs 414 and beveled edges 114 on the doors 302 provide an overlapping cavity closure that insulates the female center contact 202 and contains the female contact 202 within the dielectric 204.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a dielectric having a right angle body comprising a first segment and a second segment extending from the first segment at a right angle corner of the body, the body defining a right angle chamber extending through the first and second segments between a distal end of the first segment and a distal end of the second segment, the dielectric including at least one door at the right angle corner, the door rotatable between an open state and a closed state, the door providing access to the right angle chamber through a rear opening at the right angle corner in the open state, the door restricting access to the rear opening in the closed state;

a female center contact configured to be received in the right angle chamber in the first segment of the dielectric, the female center contact having a mating end configured to electrically connect to a mating contact of a mating connector and a terminating end configured to electrically connect to a cable conductor of a cable received in the right angle chamber in the second segment;

a front shield receiving a front of the dielectric, wherein upon loading the dielectric into the front shield, the front shield forces the door to move from the open state to the closed state; and a rear shield receiving a rear of the dielectric, the rear shield being configured to couple to the front shield.

2. The connector assembly of claim 1, wherein the door is rotatable on a living hinge along an axis that is parallel to the orientation of the second segment of the dielectric.

3. The connector assembly of claim 1, wherein the dielectric includes two doors located on opposite sides of the rear opening and the two doors meet at an interface in the closed state.

4. The connector assembly of claim 1, wherein the front shield is die cast and the rear shield is stamped and formed on a carrier strip.

5. The connector assembly of claim 1, further comprising an outer contact configured to be inserted at least partially within a cavity of the front shield and an outer housing configured to couple to the front shield at least partially surrounding the outer contact, wherein the outer housing has a mating interface defining a socket for mating with the mating connector.

6. The connector assembly of claim 1, wherein the rear shield includes at least one wing extending forward from a front of the rear shield, the wing configured to be inserted through a slot in the front shield and fastened to couple the rear shield to the front shield.

7. The connector assembly of claim 1, wherein the cable is inserted into the right angle chamber through an opening at the distal end of the second segment, the cable conductor oriented perpendicular to the female center contact within the first segment.

8. The connector assembly of claim 1, wherein the terminating end of the female center contact includes a flared receptacle having first and second arms that engage opposite sides of the cable conductor to create a mechanical and electrical connection with the cable conductor.

9. The connector assembly of claim 1, wherein the rear shield is configured to couple to the front shield to form a shield assembly having a mounting portion at a bottom thereof, the cable couples to the shield assembly by dressing a braid of the cable around the mounting portion and crimping a ferrule on the braid to fasten the braid to the mounting portion.

10. The connector assembly of claim 1, wherein the female center contact is received into the right angle chamber through the rear opening at the right angle corner when the door is in the open state, and the female center contact is confined within the right angle chamber when the door is rotated to the closed state.

11. The connector assembly of claim 1, wherein the front shield defines a cavity configured to receive the first segment of the dielectric therethrough, and the front shield further defines a groove along a rear of the front shield that is configured to receive the second segment of the dielectric therein.

12. The connector assembly of claim 1, wherein the front shield includes at least one closing tab configured to force the door to move from the open state to the closed state as the front of the dielectric is loaded into the front shield.

13. The connector assembly of claim 12, wherein the dielectric includes two doors and the front shield includes two closing tabs, the closing tabs differing in length such that the closing tabs force the doors to close in a staggered sequence.

14. A connector assembly comprising:

a dielectric having a right angle body comprising a first segment and a second segment oriented at a right angle to the first segment, the body defining a right angle chamber extending through the first and second segments between a distal end of the first segment and a distal end of the second segment; and a female center contact configured to be received in the right angle chamber in the first segment of the dielectric, the female center contact having a mating end configured to electrically connect to a mating contact of a mating connector and a terminating end configured to electrically connect to a cable conductor of a cable received in the right angle chamber through an opening at the distal end of the second segment, the cable conductor oriented perpendicular to the female center contact within the first segment, the terminating end includes a flared receptacle having first and second arms that engage opposite sides of the cable conductor to create a mechanical and electrical connection with the cable conductor.

15. The connector assembly of claim 14, wherein the flared receptacle further includes a lower surface having an aperture therethrough and first and second side walls extending upwards from the lower surface, the first and second arms extending generally downward from tops of the respective first and second side walls toward the lower surface on opposing sides of the aperture to define a contact region therebetween.

16. The connector assembly of claim 14, wherein the flared receptacle includes a planar surface having an aperture at a center thereof and the first and second arms curl from edges of the planar surface towards the center, wherein the cable conductor extends through the aperture and engages the first and second arms.

17. The connector assembly of claim 16, wherein flared tips of the first and second arms are flared outward relative to the aperture defining a guide section within a contact region configured to guide the cable conductor into an interference fit between the first and second arms.

18. The connector assembly of claim 14, wherein the dielectric includes at least one door at a right angle corner of the body, the door rotatable between an open state and a closed state, the door providing access to the right angle chamber through a rear opening at the right angle corner in the open state, the door restricting access to the rear opening in the closed state.

19. The connector assembly of claim 18, further comprising a front shield configured to receive a front of the dielectric, wherein the front shield includes at least one closing tab configured to force the door to move from the open state to the closed state as the front of the dielectric is loaded into the front shield.

20. The connector assembly of claim 18, wherein the female center contact is received into the right angle chamber through the rear opening at the right angle corner when the door is in the open state, and the female center contact is confined within the right angle chamber when the door is rotated to the closed state.

* * * * *